US012397945B2

(12) United States Patent
Gropper et al.

(10) Patent No.: US 12,397,945 B2
(45) Date of Patent: Aug. 26, 2025

(54) METHOD FOR CONTROLLING THE OPERATION OF A PRODUCTION LINE AND PRODUCTION LINE SUITABLE THEREFOR

(71) Applicant: MULTIVAC SEPP HAGGENMÜLLER SE & CO. KG, Wolfertschwenden (DE)

(72) Inventors: Daniel Gropper, Boos (DE); Pascal Schilling, Leutkirch (DE)

(73) Assignee: MULTIVAC Sepp Haggenmüller SE & Co. KG, Wolfertschwenden (DE)

( * ) Notice: Subject to any disclaimer, the term of this patent is extended or adjusted under 35 U.S.C. 154(b) by 0 days.

(21) Appl. No.: 18/599,616

(22) Filed: Mar. 8, 2024

(65) Prior Publication Data

US 2024/0300684 A1 Sep. 12, 2024

(30) Foreign Application Priority Data

Mar. 10, 2023 (DE) ..... 102023106000.7

(51) Int. Cl.
*B65B 57/00* (2006.01)
*B65B 25/06* (2006.01)
*B65B 35/44* (2006.01)

(52) U.S. Cl.
CPC ..... *B65B 25/06* (2013.01); *B65B 35/44* (2013.01)

(58) Field of Classification Search
CPC ..... B26D 2210/02; B26D 5/00; B26D 7/30; B26D 7/32; B65B 57/00; B65B 25/06; B65B 31/022
See application file for complete search history.

(56) References Cited

U.S. PATENT DOCUMENTS 4,941,375 A * 7/1990 Kasper ..... B26D 5/20 83/73
6,935,215 B2 * 8/2005 Lindee ..... B26D 7/32 83/155
7,593,785 B2 * 9/2009 Blaine ..... B26D 7/30 700/103

(Continued)

FOREIGN PATENT DOCUMENTS

DE 102021102385 8/2022
WO 2017021556 A1 2/2017

OTHER PUBLICATIONS

German Search Report re Application No. DE102023106000.7; Applicant: Multivac Sepp Haggenmueller SE & Co. KG, Nov. 27, 2023 (with English machine translation) (16 pages).

(Continued)

*Primary Examiner* — Andrew M Tecco
(74) *Attorney, Agent, or Firm* — Brooks Kushman P.C.

(57) ABSTRACT

In order to be able to achieve a control target (Z) selected by a user in the simplest possible way during operation of a production line (500), performance indicators (LKs) are calculated from performance parameters (LP) which are measurable or discernible or can be specified and can originate from several different machines (100, 200, 300) of the production line (500). By achieving or even optimizing these one or more performance indicators (LKs) stored in a control with control target (Z) within their target range, it is ensured that the overall regulation target (Z), i.e. for the entire production line (500), is also achieved.

20 Claims, 5 Drawing Sheets

(56) References Cited

U.S. PATENT DOCUMENTS

| | | | | |
|---|---|---|---|---|
| 9,008,824 | B1 * | 4/2015 | Blaine | G05B 19/188 700/103 |
| 9,102,428 | B2 * | 8/2015 | Grasselli | B65B 5/101 |
| 9,983,572 | B2 * | 5/2018 | Pfarr | B26D 1/28 |
| 10,843,834 | B2 * | 11/2020 | Ehrmann | B29C 66/53461 |
| 11,286,075 | B2 * | 3/2022 | Grasselli | B65B 5/068 |
| 11,485,534 | B2 | 11/2022 | Ehrmann et al. | |
| 11,685,608 | B2 * | 6/2023 | Schröder | B65G 47/26 198/457.03 |
| 11,911,925 | B2 * | 2/2024 | Hartmann | B26D 7/2628 |
| 2012/0159900 | A1 * | 6/2012 | Grasselli | B65G 47/90 53/235 |
| 2012/0198795 | A1 * | 8/2012 | Mezzaro | B65B 57/06 53/461 |
| 2012/0198974 | A1 * | 8/2012 | Weber | B26D 5/007 83/365 |
| 2014/0260853 | A1 * | 9/2014 | Grasselli | B26D 3/18 83/284 |
| 2018/0118388 | A1 * | 5/2018 | Grasselli | B65B 25/065 |
| 2018/0222619 | A1 * | 8/2018 | Ehrmann | B65B 51/10 |
| 2018/0297730 | A1 * | 10/2018 | Ehrmann | B29C 51/46 |
| 2022/0024064 | A1 * | 1/2022 | Hartmann | B26D 1/28 |

OTHER PUBLICATIONS

Multivac Easy Connect Advertisement, Higher-level recipe management increases efficiency and process reliablity. Lots of added value for the user. (Jun. 17, 2016). Retrieved from https://prozesstechnik.industrie.de/food/viel-mehrwert-fuer-den-anwender/#slider-intro-2 (with English translation) (10 pages).

* cited by examiner

METHOD FOR CONTROLLING THE OPERATION OF A PRODUCTION LINE AND PRODUCTION LINE SUITABLE THEREFOR

CROSS-REFERENCE TO RELATED APPLICATIONS

This application claims foreign priority benefits under 35 U.S.C. § 119(a)-(d) to European patent application number DE 10 2023 106 000.7, filed Mar. 10, 2023, which is incorporated by reference in its entirety.

TECHNICAL FIELD

The disclosure relates to a production line comprising several machines in succession, namely

- a packaging machine with a feeder station for feeding and packaging portions, in particular of a food product,
- a slicing machine, such as a slicer, for cutting food calibers into slices and grouping the slices into portions, wherein the slicing machine also comprises a discharge unit for the portions,
- a transport and buffer machine, hereinafter referred to as TP machine, in-between for transporting and buffering portions, in order to feed portions, usually weight-tested, of one or more slices cut by the slicing machine to the feeder station of the packaging machine at the correct feeder timing and, if necessary, correctly aligned with the track spacing of the multi-track packaging machine.

Both the discharge unit and the TP machine usually consist of a plurality of conveyor belts arranged in the passage direction through the machine and, in the case of multi-track machines, also of a plurality of several conveyor belts arranged side by side transversely to one another.

In practice, such a TP machine is called a feeder. The TP machine and the discharge unit of the slicing machine together form a transport section over which the portions must be transported from their production to their deposition into or onto the packaging element.

In the following, reference to the slicer is made often, which, however, is not intended to limit the disclosure to this type of slicing machine.

BACKGROUND

In a production line of this type, the focus is on its performance, usually specified in terms of the cycle time with which the packaging elements—which generally move forward in increments—are moved in the packaging machine.

This is because the packaging machine is usually a deep drawing packaging machine in the case of which a strip of deep-drawable plastic film is deep drawn in sections at a standstill directly upstream of the feeder station at which the portions are deposited on or in the packaging elements, as a result of which packaging troughs are formed in the film strip, usually several packaging troughs in succession per deep drawing process in the passage direction per track.

The number and arrangement of packaging troughs produced in a single deep drawing process or the corresponding number and arrangement of portions to be deposited in these troughs is referred to as the format. As these are usually multi-track slicing machines and also multi-track packaging machines, the troughs and corresponding portions form a two-dimensional format.

As the film strip also moves forward in increments at the feeder station due to the incremental deep drawing process (deep drawing cycle), a complete format of portions must be fed in cycles (feeder cycle=deep drawing cycle) into the corresponding format of troughs at the feeder station as it moves forward.

On the one hand, the TP machine assembles the portions into the correct formats and at the correct positions of the TP machine and, on the other hand, provides a buffer for portions and entire formats so that in the event of an interruption to the slicing operation—which regularly occurs when the slicer is loaded with one or more new product calibers—the packaging machine can continue to work fed from this buffer.

For this reason, the slicer's slicing capacity is usually slightly higher than the packaging machine's feeding capacity, or, in the case of a deep drawing packaging machine, usually its deep drawing capacity or another capacity limiting the packaging machine's capacity.

Nevertheless, in certain situations, the average cycle frequency and thus the feeding capacity (with an inverse analogous increase in cycle time) of the packaging machine will decrease when the slicing operation is interrupted, however not during the interruption, as the packaging machine is fed from the buffer during this time, but rather after resumption of the slicing operation, as time is required to close the gap between the last format in the feeder and the new portions produced on the transport section after the interruption.

Since the packaging elements, in particular the trough belt, have a defined running speed during their movement phases, the last belt of the TP machine, the so-called feeder belt, which ejects the format on it, e.g. into the troughs, must also have the same running speed during feeding and thus often also the upstream belts, in particular buffer belts, of the TP machine.

Furthermore, not all conveyor belts can be considered as buffer belts within the TP machine and, for the same reason, within the discharge unit of the slicing machine, as a buffer belt must be able to transfer the one or more portions stored on it to the following belt with accurate positioning even after a standstill.

A conveyor belt can therefore be ruled out as a buffer belt as it is too short to bring a portion stored on it up to this running speed when put into operation to the end of this conveyor belt. If there is space for more than one portion in succession on this buffer belt, only one or part of these portion positions can be released as a buffer position, since the above condition is met for this, but one or some other buffer positions on this buffer belt cannot be released for this, hereinafter referred to as a non-buffer position.

Likewise, a conveyor belt cannot be considered as a buffer belt if it is not driven by a servo motor, as it can then not be controlled precisely in terms of time and speed profile, which is why a synchronous transfer to a downstream belt with accurate positioning is not possible.

Other functions such as weighing the portions, discharging scrap portions, adjusting the portions running next to each other to the track spacing of the packaging machine, rotating and aligning the portions, etc. are usually performed by the conveyor belts of the discharge unit of the slicer or the downstream first belts of the TP machine and are controlled by the control, as these contain appropriately designed conveyor belts.

In addition to the previously described relationships between the parameters of the individual machines of the production line, there are many other complex relationships, which makes it difficult to control and in particular regulate the production line towards a specific regulation target.

Regulation targets can be

- the highest possible output of finished packages from the production line,
- the most consistent possible cycle operation of the packaging machine,
- a reduced output of finished packaging compared to the possible maximum value, for example due to insufficient staff to run a maximum output,
- the gentlest possible product transport on the transport section,
- the cleanest possible cut of the slices,
- the most uniform possible appearance of the portions.

SUMMARY

It is therefore an object of the disclosure to provide a method for simple control, in particular regulation, of a production line to a selectable regulation target, as well as to provide a production line suitable therefor without significantly increasing the structural complexity of the production line.

With regard to the method for controlling, in particular regulating, a production line which usually comprises several machines in succession, namely

- a single-track or multi-track slicing machine, in particular a slicer, in which product or food calibers are cut into slices and the slices are grouped into portions,
- a packaging machine for packaging the portions, with a feeder station in which a portion can be deposited on or in a packaging element,
- a transport and buffer machine, referred to as TP machine, for transporting the portions from the slicing machine to the feeder station of the packaging machine and buffering in-between,
- a line control for controlling moveable parts of the production line, it is known that there are performance indicators for the production line, which reflect the performance of the production line under certain aspects, and are calculated from performance parameters which can be measured on the machine or are otherwise discernible, for example cycle times, rotational speeds, number of slices per portion or the like.

The performance parameters can be freely selectable, usually within a permissible range, or fixed, but can also change, particularly in relation to the order.

Furthermore, it is known that a selection of regulation targets, such as those listed above by way of example, is available for selection, for the achievement of which in each case a target value or a target range limited on one or both sides must be achieved for at least one of the performance indicators, whereby the performance indicator is correlated with the corresponding regulation target via this condition.

According to the disclosure, this object is achieved in that the user selects a specific regulation target and, depending on this, the at least one freely selectable performance parameter is automatically controlled, in particular regulated, by the control in such a way that the performance indicators correlated with the selected control target or regulation target as described above are achieved, i.e. the corresponding target value for this performance indicator is achieved or the target range specified for this target is maintained by this performance indicator.

If the performance indicator is to lie within a certain target range for a specific control target or regulation target, at least one of the performance parameters correlated with this performance indicator can be controlled or regulated in particular in such a way that the performance indicator calculated from it is optimized within the target range in the direction of a specified primary optimization target.

In this way, the user does not have to worry about how to set individual performance parameters on the production line; it is sufficient to specify the corresponding regulation target or control target to the control.

If the user wishes, the user can also specify to the control one or more of the freely selectable performance parameters in addition to the regulation target or control target, which of course restricts the scope of action of the control, but also allows the user to make specific specifications for an individual performance parameter in addition to a general target.

The user can also specify a limit value for a performance parameter monitored within the production line, in particular a monitorable quality criterion, which is then to be achieved in addition to the general target, preferably as a second priority.

Such a quality criterion can be, for example, the wrinkle-free deposition of slices within a portion.

In this way, performance parameters or quality criteria that are particularly important to the user can be specified by the user in addition to a general control target or regulation target.

Due to the complex interaction of the machines within the production line, the performance indicators are usually calculated using performance parameters that are derived from or relate to different machines in the production line, as this is usually the only way to achieve and maintain a general target the entire production line.

For the freely selectable performance parameters, a permissible range is usually specified which, however, can change depending on the order, i.e. for example depending on the product.

The calculation of a specific performance indicator can be carried out either with the help of the line control or with the help of one of the machine controls that are generally available at each machine.

Alternatively, a calculation can also be carried out on an external control that runs on the internet, i.e. in the Cloud, for example.

The calculation can also be carried out in the form of a simulation, which is carried out on such a machine control or line control or Cloud control, instead of during real machine operation.

A first performance indicator can be a performance indicator LK1 reflecting the number of portions packaged per unit time, which is calculated using the following performance parameters:

- AnzP=number of portions that can be produced from one product caliber
- U/s=rotational speed of the blade of the slicing machine,
- T/s=number of cycles of the packaging machine,
- AnzR=number of successive portions of a format (F) present fed at once at the feeding point (301) in the passage direction (10*),
- Lt=loading time for loading the slicer, i.e. the timespan between the end of the last cut before loading and the start of the first cut after loading,
- AnzS=number of slices per portion,
- AnzL=number of blank cuts of the slicing machine between two successively produced portions.

Preferably, this performance indicator LK1 is calculated using the following formula:

$$LK1 = (AnzP \times U/s)/[T/s \times AnzR \times (Lt \times U/s + AnzP \times (AnzS + AnzL))]$$

A second performance indicator can be the second performance indicator LK2 reflecting a sufficient buffering capacity of the TP machine and is calculated using the following performance parameters:

Pt=time that the packaging machine can be operated from standstill of the slicing machine using the buffered portions, Wt=refill time, namely loading time Lt plus the transport time Tt of the first portion after restarting the slicing machine from the slicing machine to the feeding point (301) of the packaging machine (300).

Preferably, this performance indicator LK2 is calculated according to the following formula:

$$LK2 = Pt/Wt$$

A first control target or regulation target selectable by the user can be, for example, a maximum output, i.e. a maximum number of portions that the production line packages and dispenses per unit of time.

For such a target, it can be stored in the control that a first performance indicator should be greater than 1, in particular in the range from 1.03 to 1.15, and/or a second performance indicator should be as high as possible, although this can still be a value below 1.0.

When the user selects this target, the control automatically and self-actingly controls or regulates the freely selectable one or more performance parameters correlated with the corresponding performance indicator in such a way that the one or more performance indicators have the value or range stored for this target.

A second control target or regulation target that selectable by the user can be a cycle operation of the packaging machine that is as consistent as possible, e.g. as this protects the machine on the one hand and the product on the other. The most consistent cycle operation possible can be understood to mean that the highest cycle time occurring during operation of the production line is a maximum of 10%, in particular a maximum of 5%, in particular a maximum of 1%, in particular a maximum of 0.1%, above the lowest cycle operation.

For such a target, it can be stored in the control that a first performance indicator should be greater than 1, in particular in the range from 1.03 to 1.15, and/or a second performance indicator should be greater than 1, in particular in the range from 1.05 to 1.20.

Optionally, the user can also specify a concrete target value to be achieved or a maximum permissible target value for one or even several freely selectable performance parameters, for example the cycle time T/s, which the control then also automatically complies with, which of course additionally restricts the control's autonomy of choice and which may mean that the specified general control target can only be achieved suboptimally.

Furthermore, it is possible that a performance indicator correlated with a selected target can be achieved at several operating points of the machine. This means that the one or more performance parameters relevant for determining this performance indicator each amount to the relevant performance indicator not just at one specific value, but at several different specific values—i.e. in the form of several value packages, each comprising one value per performance parameter—with a specified target value or in a specified target range.

In this case, a secondary performance parameter, for example a quality criterion, can be stored as known for each of these operating points, which in particular is not included in the calculation of the performance indicator, i.e. is not used for its calculation.

The user can then—in addition to a control target or regulation target selected by him and, if applicable, also in addition to an optimization direction specified by him for a performance indicator within its target range-specify such a secondary performance parameter, according to which the control then selects one of the several possible operating points.

As is known, a production line for producing and packaging portions from one or more slices cut from a product caliber generally comprises

- a packaging machine with a feeder station in which a portion can be deposited on or in a packaging element,
- a single-track or multi-track slicing machine, in particular a slicer, for cutting slices from a product caliber, including a discharge unit usually having several conveyor belts for the slices, including a portioning belt which is capable of placing several slices at least partially on top of one another to form a portion,
- a TP machine for buffering and feeding the portions from the slicing machine to the feeder station of the packaging machine by means of several conveyor belts, at least part of which can be used as a buffer belt,
- a control for controlling moveable parts of the packaging line.

With regard to such a production line, the present object is achieved in accordance with the disclosure in that the packaging line, in particular its control, is designed in such a way that it is capable of carrying out the method described above.

This makes it possible to achieve the advantages described with reference to the method.

Preferably, the production line has at least one sensor for a detectable, in particular measurable, performance parameter, in particular for those performance parameters that are used in the calculation of a performance indicator. By readjusting such performance parameters, the correlated performance indicator can be maintained at the target value or within the target range during operation of the production line.

This allows the production line to be optimized even better in its operation.

Preferably, at least part of the conveyor belts within the transport section of the production line is designed so as to be usable as buffer belts, in particular by being equipped with a controllable servo drive.

The more conveyor belts are such buffer belts, the more portions, in particular complete formats, can be buffered on them in order to be able to continue operating the packaging machine from this buffer during a slicing stop, for example due to reloading of the slicing machine with calibers.

Preferably, the production line also comprises

- a weighing belt with a scale for weighing a portion and/or

- a discharge belt, in particular a teeter belt for discharging a defective portion and/or

- a distribution belt or splaying belt for spacing the portions from the track spacing of the slicer to the track spacing of the packaging machine and/or an adjustment belt for arranging the corresponding portions on the different tracks in the same longitudinal position and/or a format belt for accurately positioning portions to form at least one format and/or a feeder belt for ejecting a format onto at least one packaging element.

This further increases the optimization possibilities for the production line.

BRIEF DESCRIPTION OF THE DRAWINGS

Embodiments according to the disclosure are described in more detail below by way of example and with reference to the following drawings, which show:

FIG. 1 shows a known, multi-track slicer 100 for simultaneously slicing several product calibers K—not shown in this figure—each on one track SP1 to SP4 next to each other and depositing them in shingled portions P each consisting of several slices S with a general passage direction 10 through the slicer 100** from right to left.

Figure 1:
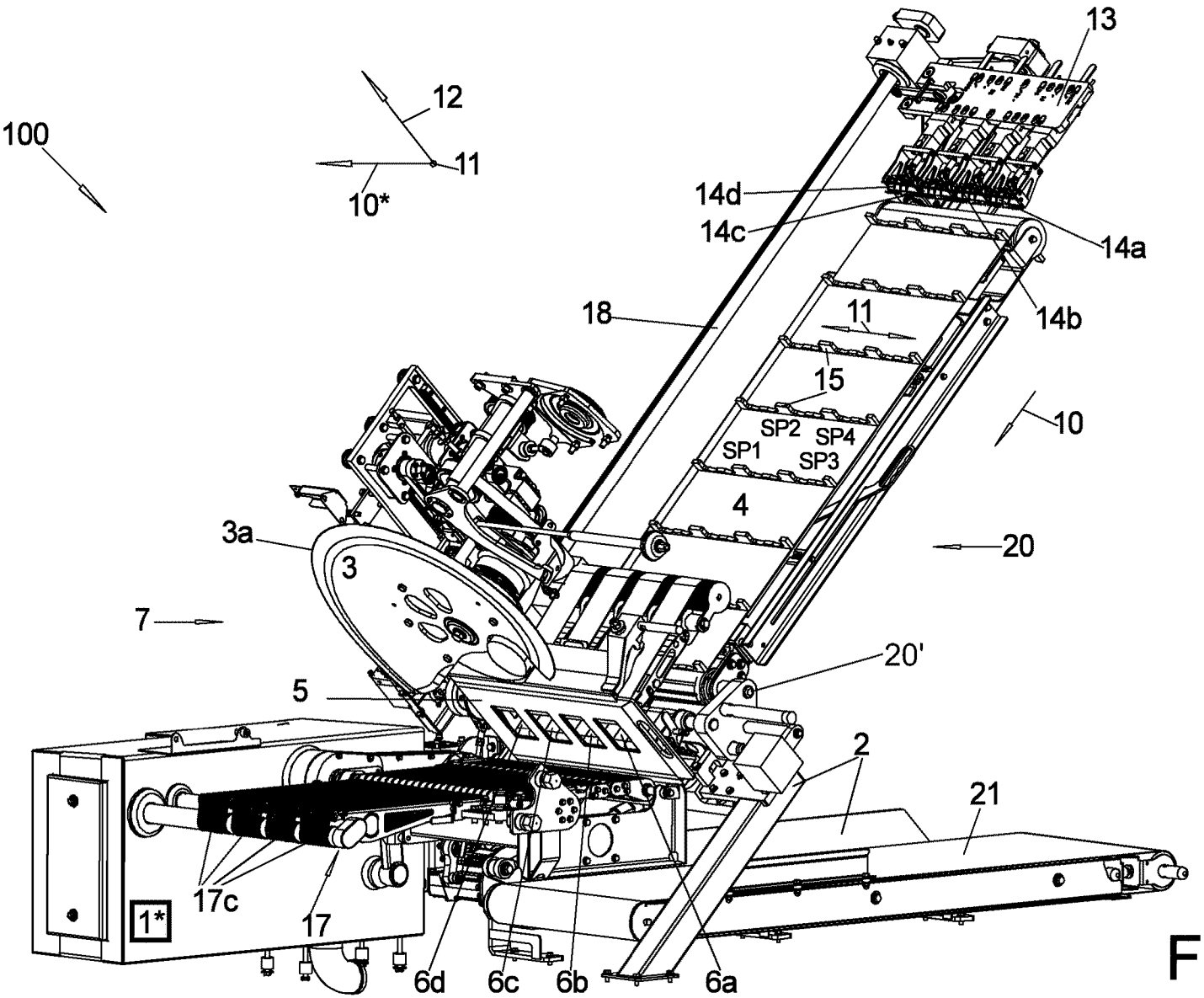
FIG. 1: a slicing machine in the form of a slicer according to the prior art in perspective view, with the supply belt folded up into the slicing position.

Their units are attached to the base frame 2. The longitudinal direction 10 is the supply direction of the calibers K to the cutting unit 7 and thus also the longitudinal direction of the calibers K lying in the slicer 1.

It can be seen that the basic structure of a slicer 100 according to the prior art is that a cutting unit 7 with blade 3 rotating around a blade axis 3', in this case a sickle blade 3, is supplied with several, in this case four, product calibers K lying next to one another transversely to the supply direction 10 on a supply conveyor 4 with spacers 15 of the supply conveyor 4 between the calibers K by this supply unit 20, from the front ends of which the rotating blade 3 cuts off a slice S with its cutting edge 3*a* in each case in one operation, i.e. almost simultaneously.

For slicing the product calibers K, the supply conveyor 4 is in the slicing position shown in FIG. 1, which is inclined in the side view, with the cutting-side front end lying low and the rear end lying high, from which it can be folded down into an approximately horizontal loading position about a pivot axis 20' running in its width direction, the 1st transverse direction 11, which is located in the vicinity of the cutting unit 7.

The rear end of each caliber K lying in the supply unit 20 is held positively by a gripper 14*a-d* with the aid of activatable and deactivatable gripper claws 16. The grippers 14*a*-14*d* are attached to a common gripper slide 13, which can be tracked along a gripper guide 18 in the supply direction 10.

Both the advance of the gripper slide 13 and of the supply conveyor 4 can be driven in a controlled manner, wherein, however, the specific supply speed of the calibers K is effected by so-called upper and lower product guides 8, 9, which are also driven in a controlled manner and which engage the top and bottom of the calibers K to be sliced in their front end sections near the cutting unit 7.

The front ends of the calibers K are each guided through a so-called product opening 6*a-d* of a plate-shaped cutting frame 5, wherein the cutting plane 3" extends directly in front of the front, downwardly inclined end face of the cutting frame 5, in which the blade 3 rotates with its cutting edge 3*a* and thus cuts off the protrusion of the calibers K from the cutting frame 5 as slices S. The cutting plane 3" runs perpendicular to the upper run of the supply conveyor 4 and/or is spanned by the two transverse directions 11, 12 to the supply direction 10.

The inner circumference of the product openings 6*a-d* serves as a counter-cutting edge of the cutting edge 3*a* of the blade 3.

Since both product guides 8, 9 can be driven in a controlled manner, in particular independently of each other and/or possibly separately for each track SP1 to SP4, these determine the—continuous or intermittent—supply speed of the calibers K through the cutting frame 5.

Below the supply unit 20, usually an approximately horizontal end piece conveyor 21 is provided, which starts with its front end below the cutting frame 5 and directly below or behind the discharge unit 17 and with its upper run thereon—by means of the drive of one of the discharge conveyors 17 against the passage direction 10**-transports falling pieces to the rear.

The slices S, which are at an angle in the room when they are cut off, fall onto a discharge unit 17 starting below the cutting frame 5 and running in the passage direction 10, which in this case consists of several discharge conveyors 17***a, b, c* arranged one behind the other with their upper runs approximately aligned in the passage direction 10, of which the first discharge conveyor 17***a* in the passage direction 10* can be designed as a portioning belt 17*a*.

The slices S can impinge on the discharge unit 17 individually and spaced apart from one another in the passage direction 10* or form shingled (see FIGS. 2*a, b*) or stacked portions P by means of appropriate control of the portioning belt 17*a* of the discharge unit 17—the movement of which, like almost all moveable parts, is controlled by the control or control unit 1—by mostly incremental forward movement of the portioning belt 17***a*.

Figure 2A:
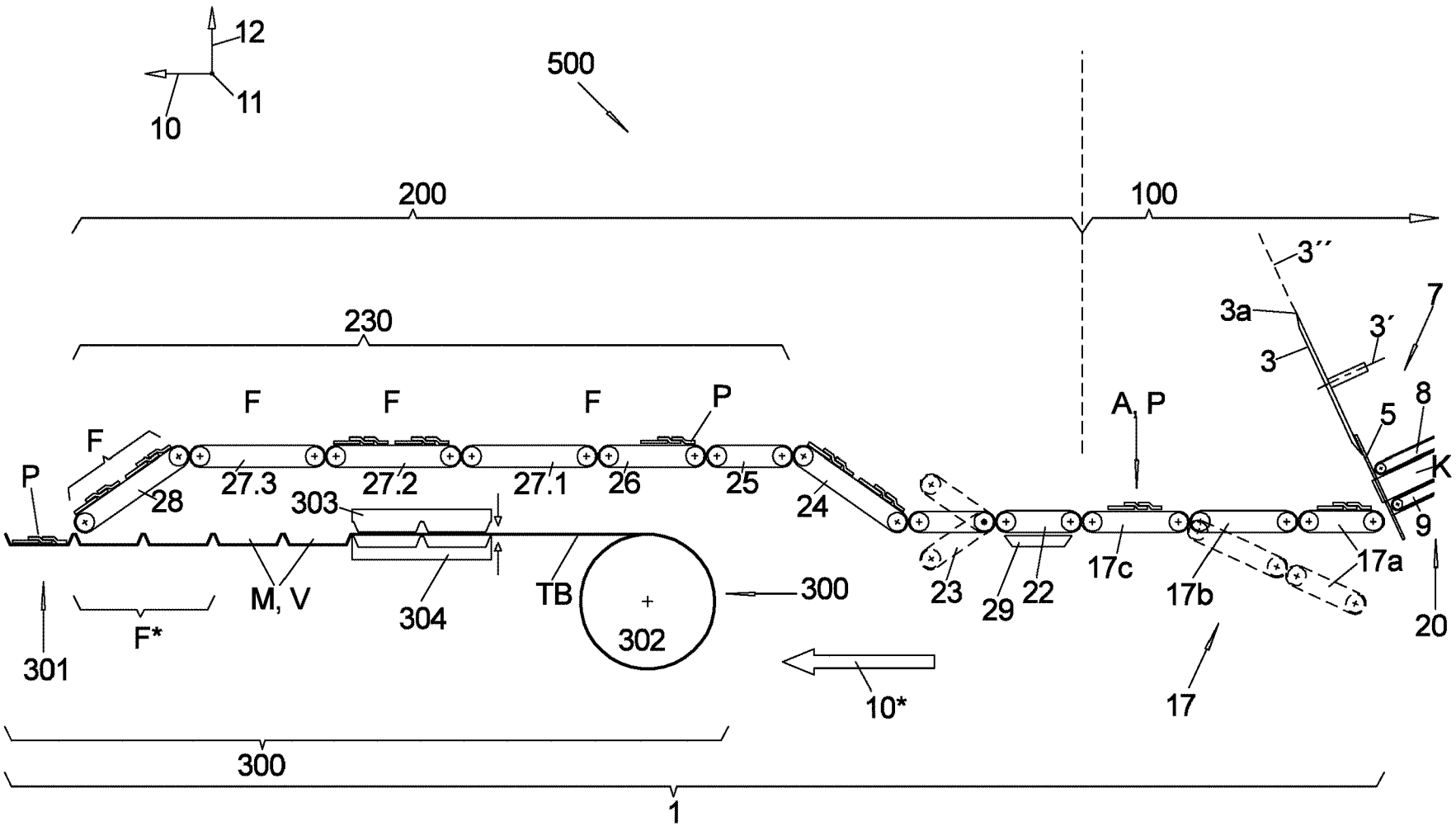
FIG. 2*a*: a side view of a production line with loading, i.e. during operation.

FIG. 2*a* shows a side view of a production line 500 with a TP machine 200 in the passage direction 10* downstream of a slicer 100, with its discharge unit 17, and a packaging machine 300 indicated by the trough belt, into the troughs M of which the feeder belt 28 of the TP machine 200 feeds the portions P at the feeder station 301, in particular a portion P consisting of three slices S each as shown.

Figure 2B:
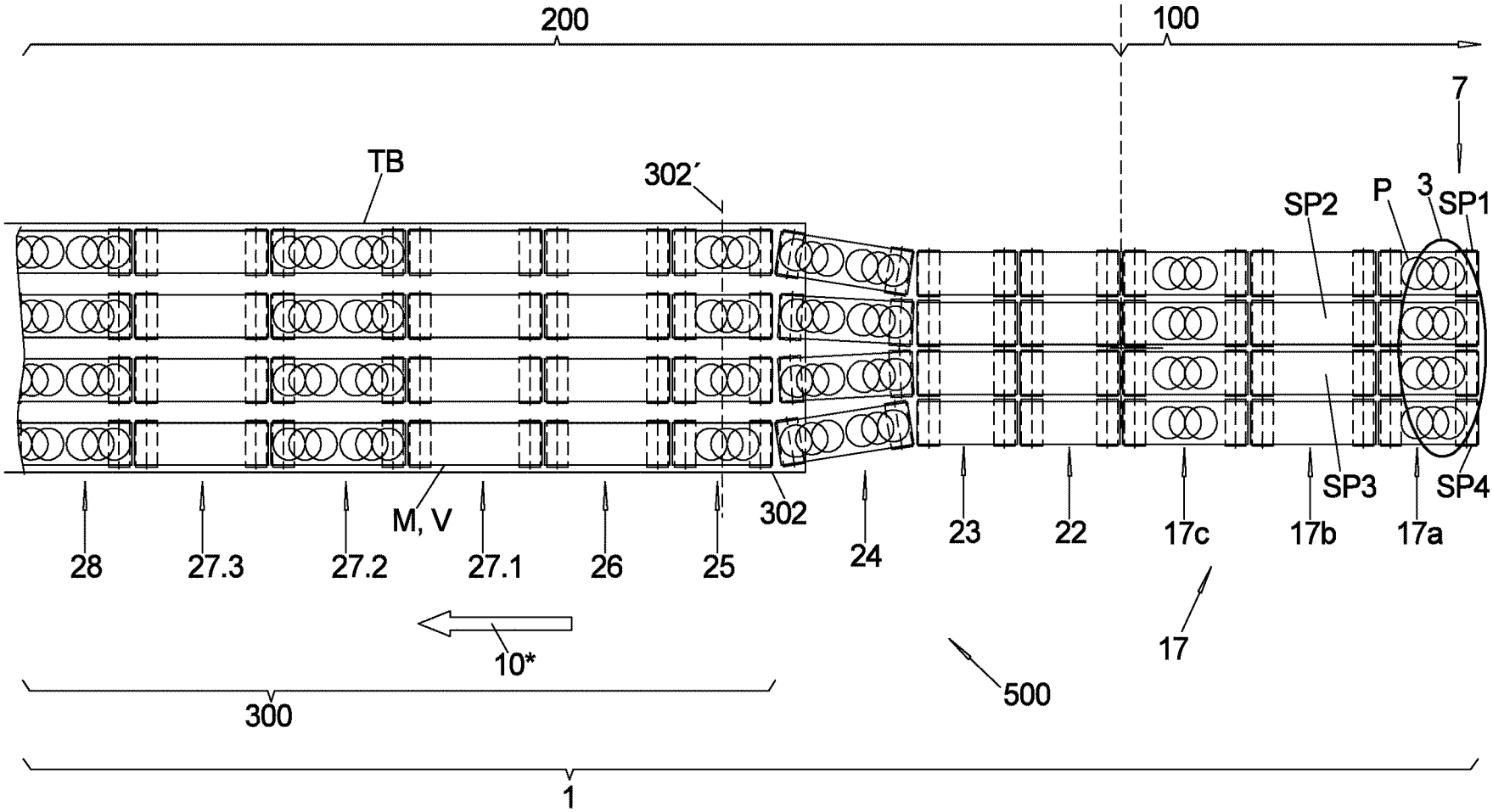
FIG. 2*b*: a top view of the production line in FIG. 2*a* in a four-track design.

The side view of FIG. 2*a* applies both to a single-track production line 500 and to a multi-track production line 500 having several tracks in succession in the viewing direction of these figures, such as a four-track production line 500, as shown in the top view of the machine of FIG. 2*a* in FIG. 2*b*. AnzR=number of successive portions present in the passage direction per format F would therefore be 2 in this case.

The production line 500 shown in FIGS. 2*a, b* comprises the following conveyor belts on each of the tracks SP1 to SP4 downstream from the cutting unit 7:

Portioning belt 17*a*, discharge belt 17*b* and transfer belt 17*c* as part of the discharge unit 17 generally still belonging to the slicer 100.

Downstream, in particular directly downstream, of this, preferably in this order, there are further provided

- a weighing belt 22 with a scale 29 for weighing a portion P thereon,
- a controlled discharge belt 23, preferably designed as a controlled pivoting teeter belt 23, for discharging an incorrectly weighted portion P,
- a distribution belt 24, often also referred to as a splaying belt 24, for spacing the portions located next to each another in the transverse direction 11 from the track spacing of the slicer 100 to the track spacing of the packaging machine 300,
- an adjustment belt 25 to bring the portions P located next to each other in the transverse direction 11 to exactly the same longitudinal position in the passage direction 10*,
- format belt 26 to group the corresponding number of portions P—in this case two portions P in succession per track-into a format F and to the correct longitudinal spacing, thus forming finished formats F.

This is followed downstream by the actual buffer section 230, comprising one or more, in this case three, buffer belts 27.1-27.3, wherein in this case the adjustment belt 25 and the format belt 26 are also part of the buffer section 230, as they also—in addition to the functions mentioned above—also fulfill a buffer function as buffer belts.

The buffer belts 27.3 and 27.2 can each hold at least one format F of portions P, whereas the buffer belt 27.1 can only hold part of a format F, in this case only one portion, while the directly upstream so-called format belt 26 can also hold a portion P, so that both can jointly buffer a format F, in particular in the correct relative position of the two portions P of which it consists, to each other, especially in the passage direction 10*.

At the end, the feeder belt 28, which is directed obliquely downwards, follows, which deposits the format F stored on it, in this case consisting of eight portions P, onto the deep drawing belt TB passing below into the analogous format F* there from troughs M of the deep drawing belt TB, for which the deep drawing belt TB and the feeder belt 28 are brought to the same speed in the passage direction 10*.

It is self-evident that the successive belts are arranged so close to each other that they are able to take a corresponding portion P from the upstream previous belt and pass it on to the downstream next belt.

The length of the format F, F* in the passage direction 10* and/or the cycle frequency T/s as well as the speed in their movement phases are determined by how many troughs M are deep-drawn from the flat deep-drawing belt TB in succession in the passage direction 10*—and of course next to each other in the transverse direction 11, usually simultaneously across all tracks—in the deep-drawing station between the upper tool 303 and the lower tool 304.

In the present case, a format F* comprises two troughs M in succession per track SP1-SP4 in the passage direction 10* and, analogously, a format F comprises two portions P per track SP1-SP4.

FIGS. 2*a, b*—per track SP1-SP4—show the loading quantity of portions P on the entire transport section 1 in normal operation at an arbitrary point in time, as the nine portions per track SP1-SP4 shown here can also be on conveyor belts other than those shown.

In normal operation, there are nine portions in the present case as the buffer section 230, i.e. from the adjustment belt 25 to the feeder belt 28, each inclusive per track SP1-SP4, provides nine deposition positions for one portion P each.

The portions distributed over the entire transport section 1 in the state shown could therefore be transported further until they are all located within the buffer section 230, from where it would be possible, even after the belts of the transport section have come to a standstill, to transfer them with accurate positioning and feed them into the troughs M as packaging means V.

Figure 3:
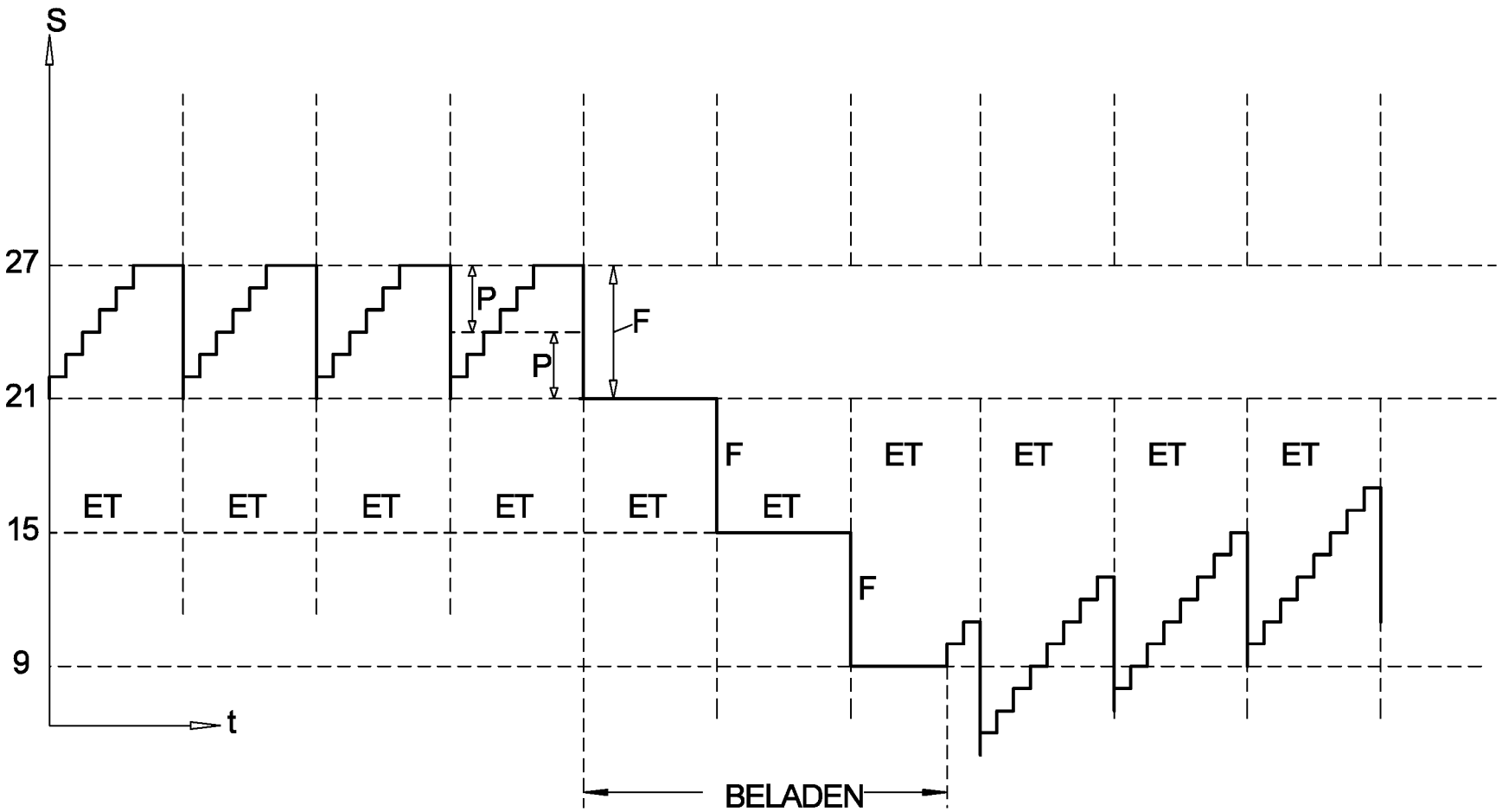
FIG. 3: a time diagram of the loading of a transport section after the slicer has been reloaded.

FIG. 3 illustrates the temporal change of the portions P present on a track SP1-SP4 of a transport section other than that of the previous figures with a higher loading capacity than the transport section 1 shown in FIGS. 2*a, b*, in particular during a standstill of the slicer 100, typically due to a necessary loading process.

On the one hand, as with the feeder line 500 as shown in FIGS. 2*a, b*, the TP machine 200 in FIG. 3 also delivers a format F to the packaging machine 300 via its feeder belt 28 after a respective feeder cycle time ET at the feeder station 301.

On the other hand, the slicer 100, which can produce one slice S per track at regular intervals corresponding to the rotation time of the blade, can produce more than the 6 slices required for one format per track, namely 8 slices, within one feeder cycle time ET.

In normal operation, therefore, after the 6 slices required for one format F have been produced, two blank cuts are made within one feeder cycle time ET, e.g. by retracting the caliber K slightly to the rear so that it is no longer in contact with the blade 3.

As a result, the occupancy of the transport section 1 with portions P changes cyclically, for example between 21 and 27 portions.

If, according to FIG. 3, the slicer 100 is stopped in order to be reloaded—which in this case requires almost three feeder cycle times ET—formats F are removed from the transport section 1, in particular its buffer section 230, in cycles during this period, as a result of which the occupancy in this case assumed in FIG. 3 has decreased to 5—with an otherwise usual occupancy of between 21 and 27—when the production of slices by the slicer 100 resumes.

Since, after loading, the average occupancy of the transport section 1 is, as a safety measure, to be increased again to the same level and thus the same buffer size as before loading, no blank cuts are made by the slicer 100 during the first feeder cycle times ET, so that it produces eight instead of six slices S per track in one feeder cycle time ET.

As can be seen, a considerable number of feeder cycle times ET is required in order to achieve the same occupancy of the transport path 1 as before the interruption to the operation of the slicer 100.

Figure 4A:
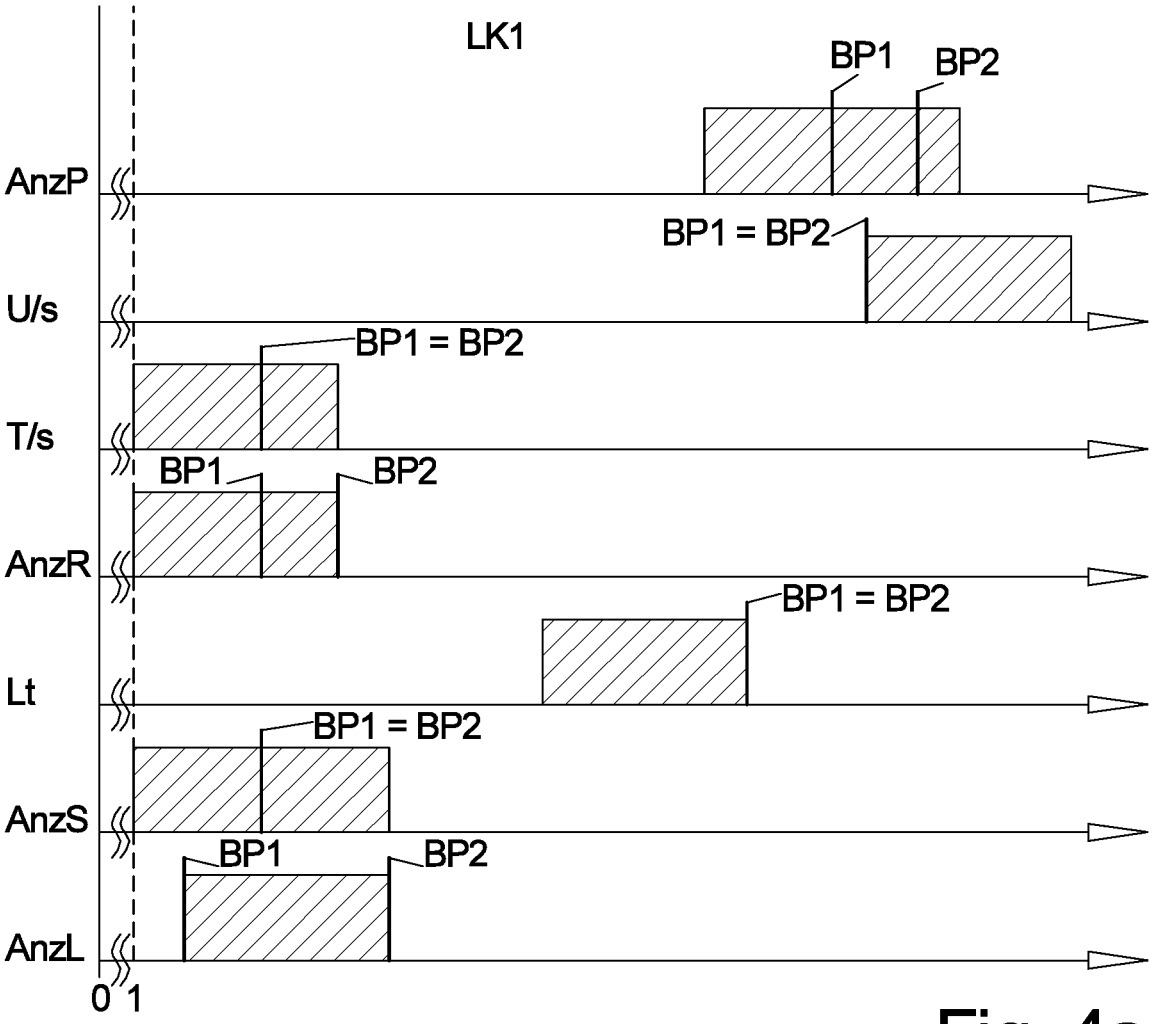
FIG. 4*a*: a diagram of the performance parameters used in the calculation of a first performance indicator.

FIG. 4*a* shows an example of the various performance parameters LP=AnzP, U/s, T/s, AnzR, Lt, AnzS, AnzL for a performance indicator LK1, which are included in the calculation of this performance indicator LK1.

Figure 4B:
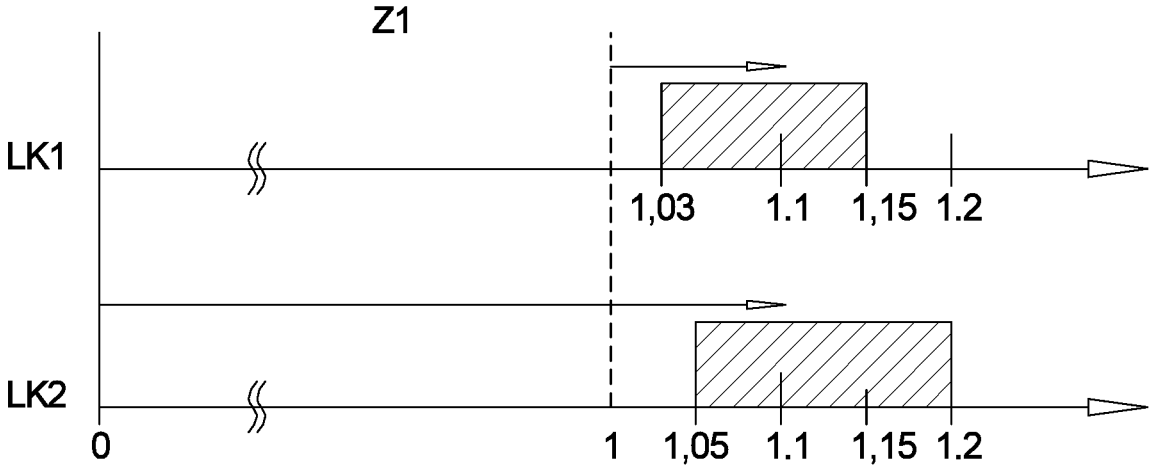
FIG. 4*b*: a diagram of several performance indicators and the relationship with a selected control target.

FIG. 4*b* shows, using the example of a first control target Z1, performance indicators LK1 and LK2 for which specific values or value ranges are specified in the control under the control target Z1, which the control complies with by corresponding control of the correlated performance parameters LP.

For the performance indicator LK1, this is a value that should be greater than 1.0, preferably between 1.03 and 1.15.

For the performance indicator LK2, the requirement is that it should be as high as possible, preferably between 1.05 and 1.2.

FIG. 4*a* shows possible or permissible value ranges for the individual performance parameters LP.

Since it is possible that a specific value of a performance parameter LK1, for example LK1, is provided at several operating points BP1, BP2 of the production line, FIG. 4*a* shows that the different operating points BP1, BP2 can mean different values or also the same value for a specific performance parameter LP.

Possible or permissible value ranges are shown for the individual performance parameters.

Since, depending on the formula for calculating the performance indicator LK1, different values or value ranges of a performance parameter LP can be considered, a prioritization with regard to the various possible operating points should be stored in the control for a control target and the value range of its correlated performance parameters stored for it, e.g. the operating point that is gentlest for the product due to the lowest accelerations.

Similarly, for a performance parameter for which a value range open on one or both sides is stored correlated with a specific performance indicator, a prioritization within this value range to a specific value or in a certain direction within the value range should also be stored in the control.

As one skilled in the art would understand, the control or control unit 1* (which may be referred to as the line control for the production line 500), the machine controls, the external control, as well an any other control, control unit, control system, controller, sensor, unit, machine, apparatus, element, device, component, system, subsystem, arrangement, or the like described herein may individually, collectively, or in any combination comprise appropriate circuitry, such as one or more appropriately programmed processors (e.g. one or more microprocessors including central processing units (CPU)) and associated memory, which may include stored operating system software and/or application software executable by the processor(s) for controlling operation thereof and/or for performing the particular algorithms represented by the various functions and/or operations described herein, including interaction and/or cooperation between any such control, control unit, control system, controller, sensor, unit, machine, apparatus, element, device, component, system, subsystem, arrangement, or the like. One or more of such processors, as well as other circuitry and/or hardware, may be included in a single ASIC (Application-Specific Integrated Circuitry), or several processors and various circuitry and/or hardware may be distributed among several separate components, whether individually packaged or assembled into a SoC (System-on-a-Chip).

LIST OF REFERENCE SIGNS

1 Transport section
1* Control
2 Base frame
3 Blade
3' Rotation axis
3" Blade plane, cutting plane
3*a* Cutting edge
4 Supply conveyor, supply belt
5 Cutting frame
6*a-d* Product opening
7 Cutting unit
8 Upper product guide, upper guide belt
8.1 Contact run, lower run
8*a* Deflecting roller facing the cutting side
8*b* Deflecting roller facing away from the cutting side
9 Bottom product guide, lower guide belt
8.1 Contact run, upper run
9*a* Deflecting roller facing the cutting side
9*b* Deflecting roller facing away from the cutting side
10 Caliber supply direction
10* Passage direction through machine
11 1st transverse direction, width direction
12 Vertical
13 Gripper unit, gripper slide
14,14*a-d* Gripper
15 Spacer
16 Gripper claw
17 Discharge unit
17*a, b, c* Discharge conveyor
17*a* Portioning belt
18 Gripper guide
19 Height sensor
20 Supply unit
21 End piece conveyor
22 Weighing belt
23 Discharge belt, teeter belt
24 Distribution belt
25 Adjustment belt
26 Format belt
27.1/.2/.3 Buffer belt
28 Feeder belt
29 Scale
100 Slicing machine, slicer
200 Feeder-supply unit
217 Transport section
230 Buffer section
300 Packaging machine
301 Feeder station
302 Supply roll
303 Upper tool
304 Bottom tool
500 Production line
A Article
ET Feeder cycle time
F, P* Format
K Product, product caliber
M Trough
S Slice
SP1-SP4 Track
TB Deep drawing belt
P Portion
V Packaging material

What is claimed is:

1. A method for regulating operation of a production line including:

a single-track or multi-track slicing machine in which product calibers are cut into slices and the slices are grouped into portions, a packaging machine for packaging the portions, with a feeder station in which a portion of the portions can be deposited on or in a packaging element, a transport and buffer machine, hereinafter TP machine, for transporting the portions from the slicing machine to the feeder station of the packaging machine and buffering in-between, and a line control for controlling moveable parts of the production line, wherein performance indicators are calculated for the production line from performance parameters which are selectable or fixed, wherein a selection of control targets is specified, for achievement of which a target value or a target range of at least one of the performance indicators is correlated, wherein the method comprises:

receiving a control target selected by a user, and automatically controlling those selectable performance parameters which are required to determine the at least one performance indicator correlated with the selected control target in such a way that the target value of the correlated at least one performance indicator required for the selected control target is achieved or the target range of the correlated at least one performance indicator is achieved;

wherein a first performance indicator LK1 reflecting a number of portions packaged per unit time is calculated using the following performance parameters:

AnzP=number of portions that can be produced from a product caliber K,

U/s=rotational speed of a blade of the slicing machine,

T/s=number of cycles of the packaging machine,

AnzR=number of rows of portions running in transverse direction to a passage direction, which comprises a format fed at once at a feeding point, Lt=loading time of the slicing machine, AnzS=number of slices per portion, AnzL=number of blank cuts of the slicing machine between two successively produced portions.

2. The method according to claim 1, further comprising receiving, from the user, specification of one or more of the selectable performance parameters with regard to target value or target range, and/or receiving, from the user, specification of a target value or target range for a performance parameter which can be monitored by sensors of the production line and which represents a quality criterion.

3. The method according to claim 1, wherein a performance indicator of the performance indicators contains performance parameters from different machines and/or a permissible range is specified for the selectable performance parameters.

4. The method according to claim 1, wherein an automatically controlled performance parameter, which is used to calculate a performance indicator for which a target range is predetermined, is controlled in such a way that the performance indicator calculated with it is optimized within this target range, and/or the at least one performance indicator correlated with the selected control target is monitored as a regulation target during operation of the production line and the selectable performance parameters associated with the at least one performance indicator are automatically readjusted during operation of the production line in such a way that during operation of the production line the necessary target value of the correlated at least one performance indicator is permanently achieved or the target range of the at least one performance indicator is achieved.

5. The method according to claim 1, wherein the calculation of a performance indicator can be carried out with aid of a machine control of one of the slicing machine, the packaging machine, or the transport and buffer machine, and the line control is superordinate to the machine controls by executing a simulation on the machine control or the line control or an external control.

6. The method of claim 1, wherein the first performance indicator LK1 is calculated using the following formula:

$$LK1 = (AnzP \times U/s)/[T/s \times AnzR \times (Lt \times U/s + AnzP \times (AnzS + AnzL))].$$

7. The method according to claim 1, wherein for a first control target or regulation target of a maximum number of portions packaged by the production line per unit of time the performance parameters correlated with the first performance indicator LK1 are controlled in such a way that LK1>1.

8. The method according to claim 7, wherein the performance parameters correlated with the first performance indicator LK1 are controlled in such a way that LK1 is in a range from 1.03 to 1.15.

9. The method according to claim 1, wherein, for a second control target or regulation target of a cycle operation of the packaging machine with a highest cycle time that is at most 10% above a lowest cycle time, the performance parameters correlated with the first performance indicator LK1 are controlled in such a way that LK1>1, and/or the performance parameters correlated with a second performance indicator LK2 are controlled in such a way that LK2>1.

10. The method according to claim 1, wherein, for a second control target or regulation target of a cycle operation of the packaging machine with a highest cycle time at most 5% above a lowest cycle time, the performance parameters correlated with the first performance indicator LK1 are controlled in such a way that LK1 is in a range from 1.03 to 1.15, each included, and/or the performance parameters correlated with a second performance indicator LK2 are controlled in such a way that LK2 is in a range from 1.05 to 1.20, each included.

11. The method according to claim 1, wherein a second performance indicator LK2 reflecting a sufficient buffering capacity of the TP machine is calculated using the following performance parameters:

Pt=time that the packaging machine can be operated from a time the slicing machine stops using buffered portions, Wt=refill time comprising loading time Lt of the slicing machine plus transport time Tt of a first portion after restarting the slicing machine from the slicing machine to a feeding point of the packaging machine.

12. The method according to claim 11, wherein the second performance indicator LK2 is calculated according to the following formula:

$$LK2 = Pt/Wt.$$

13. The method according to claim 12, further comprising receiving, from the user, a specific target value or a maximum target value for a freely selectable performance parameter.

14. The method according to claim 1, wherein when the target value or target range of a performance indicator correlated with a control target or regulation target is achieved at a plurality of operating points, at least one secondary performance parameter is stored for each of the individual operating points, which is not included in the calculation of the performance indicator, this secondary performance parameter is additionally selectable by the user as a secondary optimization target.

15. A production line for producing and packaging of portions each including one or more slices cut from a product caliber, comprising:

a packaging machine with a feeder station in which a portion can be deposited on or in a packaging element;

a single-track or multi-track slicing machine for separating slices from a product caliber, including a discharge unit for the slices;

a transport and buffer machine in-between the slicing machine and the packaging machine for transporting and buffering the portions; and a control unit;

wherein performance indicators are calculatable for the production line from performance parameters which are selectable or fixed, and a selection of control targets is specifiable, for achievement of which a target value or a target range of at least one of the performance indicators is correlatable, wherein the control unit is configured to, based on a control target selected by a user, automatically control those selectable performance parameters which are required to determine the at least one performance indicator correlated with the selected control target in such a way that the target value of the correlated at least one performance indicator required for the selected control target is achieved or the target range of the correlated at least one performance indicator is achieved, and wherein a first performance indicator LK1 reflecting a number of portions packaged per unit time is calculatable using the following performance parameters:

AnzP=number of portions that can be produced from a product caliber K,

U/s=rotational speed of a blade of the slicing machine,

T/s=number of cycles of the packaging machine,

AnzR=number of rows of portions running in transverse direction to a passage direction, which comprises a format fed at once at a feeding point, Lt=loading time of the slicing machine, AnzS=number of slices per portion, AnzL=number of blank cuts of the slicing machine between two successively produced portions.

16. The production line according to claim 15, wherein the production line has at least one sensor connected to the control unit, wherein the at least one sensor is configured to detect a performance parameter.

17. The production line according to claim 15, wherein the production line comprises conveyor belts within a transport section, and one or more of the conveyor belts within the transport section are designed in such a way that they are usable as buffer belts.

18. The production line according to claim 17, wherein the one or more conveyor belts are equipped with controllable servo drives.

19. The production line according to claim 16, wherein the production line comprises a weighing belt with a scale for weighing a portion and/or a discharge belt for discharging a portion and/or a distributing belt or splaying belt for bringing portions running side by side onto a track spacing of the packaging machine and/or a compensating belt for bringing portions running side by side in a direction of travel to a same position and/or a format belt for accurately positioning portions to form at least one format and/or a feeder belt for transferring a format onto at least one packaging means.

20. A method for regulating operation of a production line including:

a single-track or multi-track slicing machine in which product calibers are cut into slices and the slices are grouped into portions, a packaging machine for packaging the portions, with a feeder station in which a portion of the portions can be deposited on or in a packaging element, a transport and buffer machine, hereinafter TP machine, for transporting the portions from the slicing machine to the feeder station of the packaging machine and buffering in-between, and a line control for controlling moveable parts of the production line, wherein performance indicators are calculated for the production line from performance parameters which are selectable or fixed, wherein a selection of control targets is specified, for achievement of which a target value or a target range of at least one of the performance indicators is correlated, wherein the method comprises:

receiving a control target selected by a user, and automatically controlling those selectable performance parameters which are required to determine the at least one performance indicator correlated with the selected control target in such a way that the target value of the correlated at least one performance indicator required for the selected control target is achieved or the target range of the correlated at least one performance indicator is achieved, wherein a performance indicator LK2 reflecting a sufficient buffering capacity of the TP machine is calculated using the following performance parameters:

Pt=time that the packaging machine can be operated from a time the slicing machine stops using buffered portions, Wt=refill time comprising loading time Lt of the slicing machine plus transport time Tt of a first portion after restarting the slicing machine from the slicing machine to a feeding point of the packaging machine.

* * * * *